US010443204B2

(12) United States Patent
Clapper et al.

(10) Patent No.: US 10,443,204 B2
(45) Date of Patent: Oct. 15, 2019

(54) SYSTEM, METHOD AND APPARATUS FOR BASEMENT FOOTER CONCRETE FORMS AND DRAINAGE-RELATED COMPONENTS

(71) Applicant: NORTH AMERICAN PIPE CORPORATION, Houston, TX (US)

(72) Inventors: Joshua E. Clapper, Downingtown, PA (US); Roy Lucas Dean, Schwenksville, PA (US)

(73) Assignee: NORTH AMERICAN PIPE CORPORATION, Houston, TX (US)

( * ) Notice: Subject to any disclaimer, the term of this patent is extended or adjusted under 35 U.S.C. 154(b) by 0 days.

(21) Appl. No.: 15/671,999

(22) Filed: Aug. 8, 2017

(65) Prior Publication Data

US 2018/0044876 A1 Feb. 15, 2018

Related U.S. Application Data

(60) Provisional application No. 62/372,535, filed on Aug. 9, 2016.

(51) Int. Cl.

| | |
|---|---|
| ***E02D 19/00*** | (2006.01) |
| ***E04B 1/70*** | (2006.01) |
| ***E04C 3/30*** | (2006.01) |
| ***E04G 11/06*** | (2006.01) |
| ***E02D 27/01*** | (2006.01) |
| ***E04B 1/00*** | (2006.01) |
| ***E04B 1/64*** | (2006.01) |

(52) U.S. Cl.

CPC ..... *E02D 19/00* (2013.01); *E02D 27/01* (2013.01); *E04B 1/70* (2013.01); *E04C 3/30* (2013.01); *E04G 11/06* (2013.01); *E04B 1/0007* (2013.01); *E04B 1/644* (2013.01)

(58) Field of Classification Search

CPC . E02D 19/00; E02D 27/01; E04B 1/70; E04B 1/644; E04B 1/0007; E04C 3/30; E04G 11/06

See application file for complete search history.

(56) References Cited

U.S. PATENT DOCUMENTS

| | | | | |
|---|---|---|---|---|
| 4,590,722 | A * | 5/1986 | Bevelacqua | E02D 31/02 138/162 |
| 4,773,195 | A * | 9/1988 | Waller | E04B 1/0023 52/302.3 |
| 4,930,272 | A * | 6/1990 | Bevilacqua | E02D 31/02 405/36 |
| 5,120,162 | A | 6/1992 | Parker | |
| 5,224,799 | A * | 7/1993 | Parker | E02D 15/02 285/64 |

(Continued)

*Primary Examiner* — Rodney Mintz

(74) *Attorney, Agent, or Firm* — Lempia Summerfield Katz LLC

(57) ABSTRACT

A system for a basement concrete form and drainage are disclosed. The system may include a lineal that is a horizontal concrete form for a footer for a wall and a basement floor. The lineal may include a rectilinear tubular structure having a cavity, an outer wall, and drain perforations in the outer wall to permit fluid transmission from the cavity to an exterior of the lineal. In addition, a retainer may be mounted to a stake for the basement concrete form when the stake is embedded in a formation underlying the lineal. The retainer may be selectively vertically positioned along the stake to adjust a height of the lineal relative to the underlying formation.

12 Claims, 8 Drawing Sheets

(56) References Cited

U.S. PATENT DOCUMENTS

| | | | | |
|---|---|---|---|---|
| 5,399,050 | A * | 3/1995 | Jacobus | E02D 27/00 249/13 |
| 5,765,323 | A * | 6/1998 | Bevilacqua | E02D 31/02 138/157 |
| 5,784,838 | A * | 7/1998 | Phillips | E04F 17/00 405/44 |
| 6,598,360 | B1 * | 7/2003 | Pratt | E02D 31/02 52/169.5 |
| 8,109,046 | B2 * | 2/2012 | Nordhoff | E04B 1/7023 52/169.5 |
| 8,297,005 | B1 * | 10/2012 | Bramble | E02D 31/002 52/169.5 |
| 8,528,276 | B2 * | 9/2013 | Bramble | E02D 31/002 52/169.5 |
| 2008/0184660 | A1 * | 8/2008 | Forner | E02D 31/00 52/745.05 |
| 2012/0180818 | A1 * | 7/2012 | Janesky | E02D 31/02 134/22.11 |
| 2013/0047534 | A1 * | 2/2013 | Bramble | E02D 31/002 52/302.3 |
| 2017/0306584 | A1 * | 10/2017 | Clapper | E02D 31/06 |

* cited by examiner

SYSTEM, METHOD AND APPARATUS FOR BASEMENT FOOTER CONCRETE FORMS AND DRAINAGE-RELATED COMPONENTS

This application claims priority to and the benefit of U.S. Prov. Pat. App. No. 62/372,535, filed on Aug. 9, 2016, which is incorporated herein by reference in its entirety.

BACKGROUND OF THE INVENTION

Field of the Disclosure

The present invention relates in general to basements and, in particular, to a system, method and apparatus for basement concrete forms and drainage-related components.

Description of the Prior Art

Basement concrete footer forms and drainage systems are well known. For example, the Form-A-Drain® system, sold by North American Pipe Corporation www.northamericanpipe.com/products/foundations, is a 3-in-1 foundation solution that forms concrete wall footings for basements, provides an integrated drainage system for the footing, and can vent radon where needed. Unlike conventional wooden concrete forms, this system uses perforated, hollow, molded boards, or lineals, that stay in place permanently after completion of the concrete pour. Because the lineals form a complete, sub-slab perimeter loop around the foundation, the system also functions as a foundation drainage and a radon collection system. Since the system stays in place, it reduces construction time as there is no need for a crew to return the next day to remove, strip, clean and transport forms to the next jobsite. Although this solution is successful, improvements to such systems continue to be interest.

SUMMARY

Embodiments of a system, method and apparatus for a basement concrete form and drainage are disclosed. For example, the system may include a lineal configured to be a horizontal concrete form for a footer for a wall and a basement floor. The lineal may include a rectilinear tubular structure having a cavity, an outer wall, drain perforations in the outer wall configured to permit fluid transmission from the cavity to an exterior of the lineal. In addition, a retainer may be configured to be mounted to a stake for the basement concrete form when the stake is embedded in a formation underlying the lineal. The retainer may be configured to be selectively vertically positioned along the stake to adjust a height of the lineal relative to the underlying formation.

In another embodiment, a system includes lineals configured to be horizontal concrete forms on opposite sides of the footer. Each lineal may include a rectilinear tubular structure having a cavity, and drain perforations configured to permit fluid transmission from the cavity to an exterior thereof. In addition, a spacer may be mounted to and extend between the lineals. The spacer may be buried in poured concrete of the footer and left in place.

Alternatively, an embodiment of an apparatus for providing a water barrier between a footer and a wall extending from the footer is disclosed. The apparatus may include an accessory that is pushed into the footer and embeds partially therein when the footer is freshly poured concrete. The accessory may protrude from a top of the footer when the footer is at least partially cured. An exposed portion of the accessory may extend beyond the top of the footer. The exposed portion can be embedded in the wall when the wall is poured as concrete on the footer, such that no portion of the accessory is visible after construction of the footer and the wall.

A form for a vertical wall formed from poured concrete may include a column having an I-beam sectional profile along a length thereof. The column can have a rectilinear structure with a cavity on a first end that extends the length of the column. The column acts as a stud for a vertical wall. The column also has a web with apertures spaced apart from each other and extending along the length of the column for poured concrete flow therethrough. The column may include a second end opposite the first end. The second end may include external recesses extending the length of the column for coupling with waterproof membranes.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
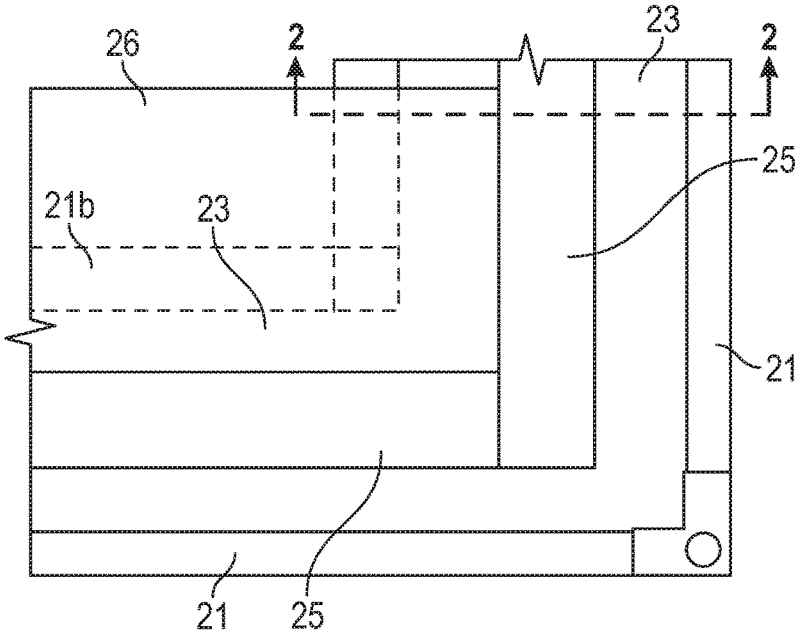
FIG. 1 is a top view of an embodiment of a basement foundation.

Embodiments of a system, method and apparatus for basement concrete forms and drainage-related components are disclosed. For example, FIGS. 1-3 disclose a system for a basement concrete form and drainage. Versions of the system may include a lineal 21 that is configured to be a horizontal concrete form for a footer 23 for a wall 25 and a basement floor 26. Embodiments of the lineal 21 may comprise a rectilinear tubular structure having a cavity 27 and an outer wall 29. Drain perforations 31 may be formed in the outer wall 29, and may be configured to permit fluid transmission from the cavity 27 to an exterior of the lineal 21.

Figure 3:
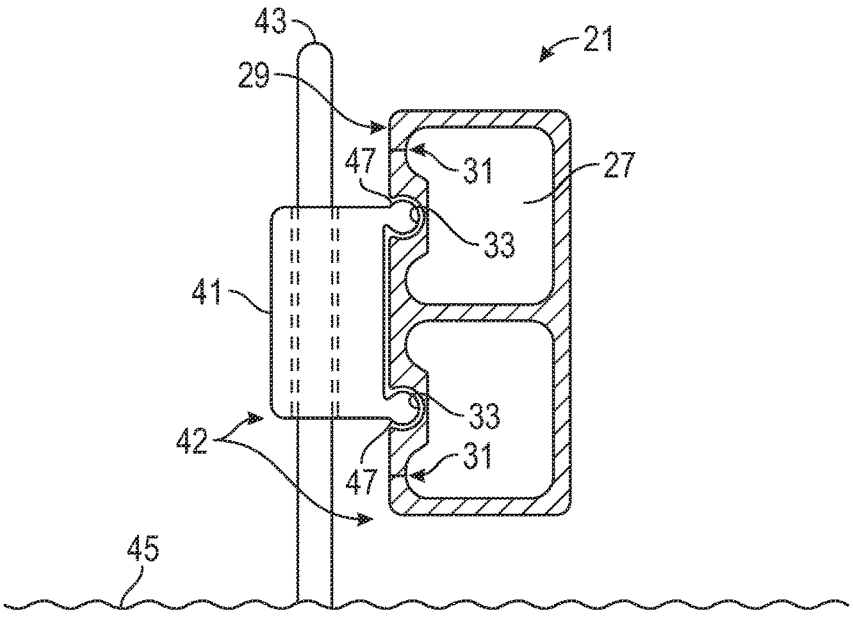
FIG. 3 is a partially-sectioned end view of an embodiment of a form mounted to a stake.

Some embodiments of the system may include a retainer 41 (FIG. 3). The retainer 41 may be configured to be mounted to a stake 43 for the basement concrete form when the stake 43 is embedded in a formation 45 underlying the lineal 21. For example, the stake 43 may be driven into an earthen formation. The retainer 41 may be configured to be selectively vertically positioned along the stake 43 to adjust a height of the lineal 21 relative to the underlying formation 45.

Versions of the retainer 41 may be configured to be mounted to the stake 43 by at least one of sliding and clamping. The retainer 41 may be configured to hold its position vertically, relative to the stake 43, and supports a weight of the lineal 21 and the retainer 41 as an assembly 42 (FIG. 2) without unintentionally slipping down the stake 43.

Other embodiments of the lineal 21 may comprise a recess 33 (FIG. 3) formed in the outer wall 29. Versions of the retainer 41 may include a rib 47 that is complementary to and configured to be coupled to the recess 33 in the lineal 21. An example of the recess 33 may include a plurality of recesses 33, and the rib 47 may include a plurality of ribs 47 that are complementary to the plurality of recesses 33. In an example, each recess 33 may comprise a cylindrical socket, and each rib 47 may comprise a cylindrical knob.

As shown in FIG. 3, an apparatus may be provided for adjusting a height of a concrete form 21 relative to a formation 45 underlying the concrete form. Examples of the apparatus may include a retainer 41 that may be configured to be mounted to the concrete form 21 and define an assembly. The assembly 21, 41 may be configured to be mounted to a stake 43 extending from the underlying formation 45 by at least one of sliding and clamping. Versions of the assembly 21, 41 may be configured to be selectively vertically positioned along the stake to adjust the height of the assembly 21, 41 relative to the underlying formation 45. Examples of the assembly 21, 41 may hold its vertical position on the stake 43 while supporting a weight of the assembly 21, 41 without unintentionally moving down the stake 43.

In some versions, embodiments of the retainer 141 (FIG. 9) may include a top arm 151 that secures over a top of the lineal 21, and a bottom arm 152 that secures under a bottom of the lineal 21. With top and bottom arms 1512, 152 the lineal 21 can be at least partially clamped inside the retainer 141.

Figure 9:
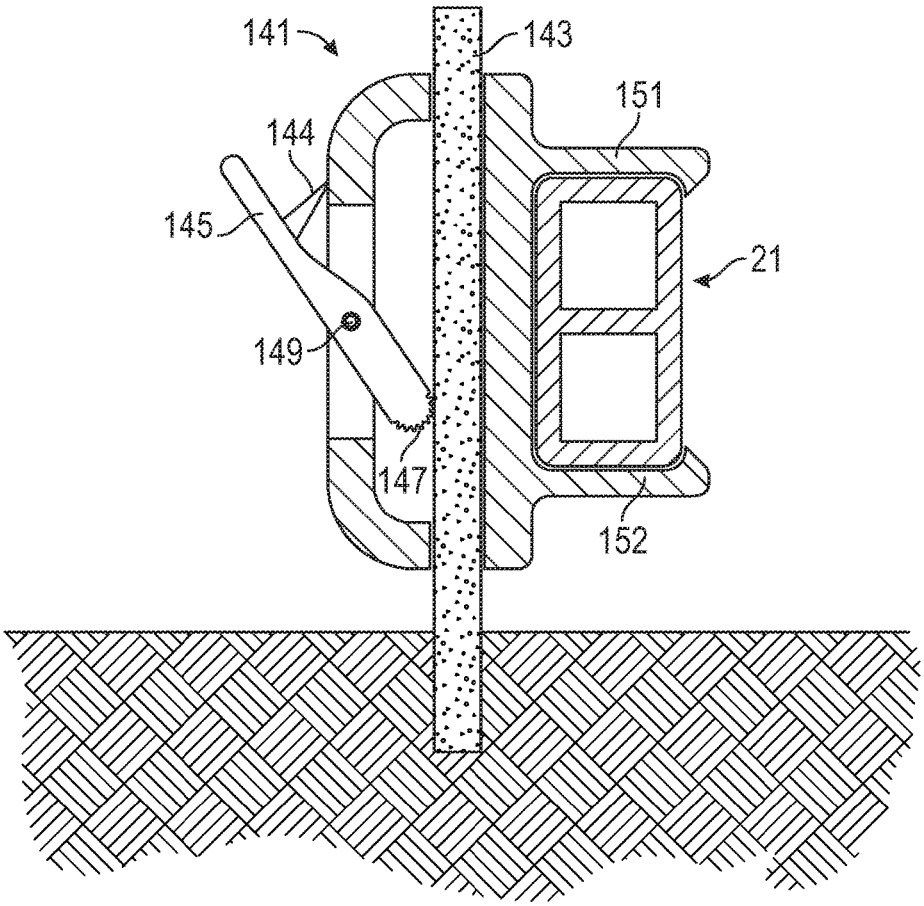
FIG. 9 is a sectional end view of another embodiment of a form mounted to a stake.

As shown in the embodiment of FIG. 9, the retainer 141 may include a lever 145 having a spring 144 that releasably loads the lever 145 against the stake 143. The lever 145 may selectively grip the stake 143 to releasably retain the assembly 21, 141 at the vertical position relative to the underlaying formation. In some versions, the spring 144 may comprise at least one of a compression spring, a clock spring and a flex finger that is integral with the lever 145. Examples of the lever 145 may pivot about a pin 149. In other examples, the lever 145 may include a pawl 147 for gripping the stake 143.

Figure 4:
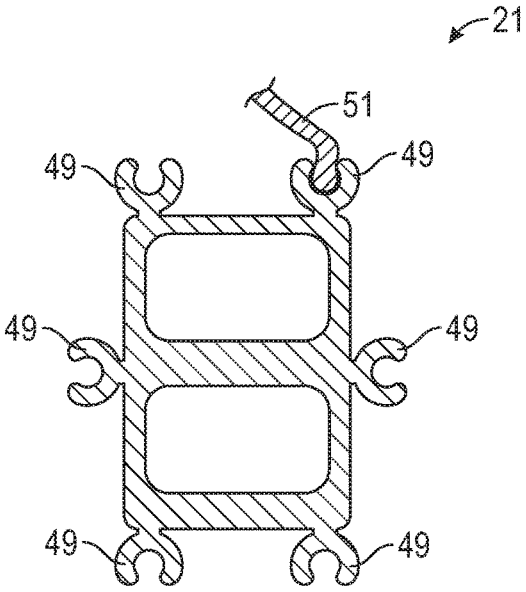
FIG. 4 is a sectional end view of another embodiment of a form mounted to an accessory.

In addition, the lineal 21 may further include a plurality of sets of clips 49 (FIG. 4) on the exterior thereof. Each set of clips 49 may be configured to attach to an accessory 51. Accessories 51 may include numerous types of devices, such as equipment for water-proofing portions of the system, and/or concrete forms. In an embodiment, both the lineal 21 and the retainer 41 may comprise molded or extruded polymers.

Figure 2:
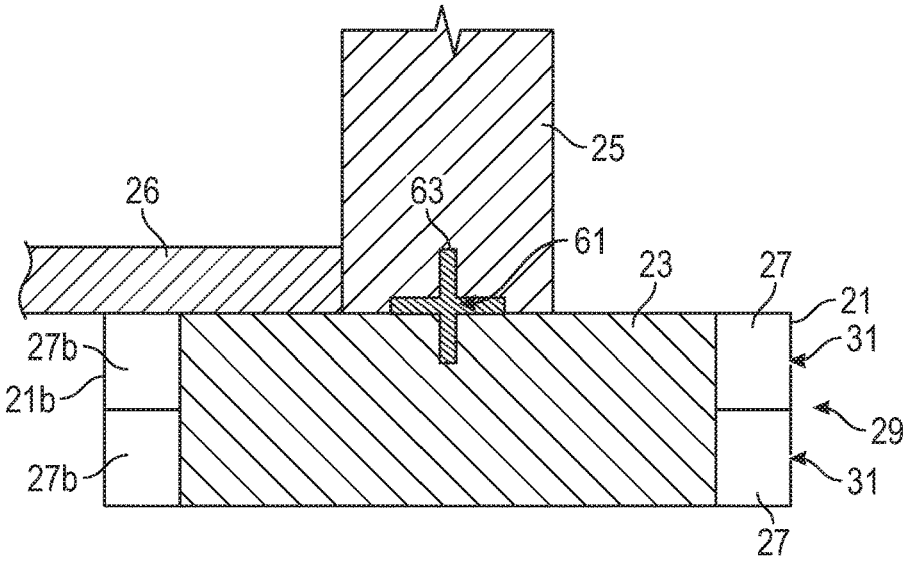
FIG. 2 is a sectional side view of the embodiment of the basement foundation of FIG. 1, taken along the line 2-2 of FIG. 1.
Figure 5:
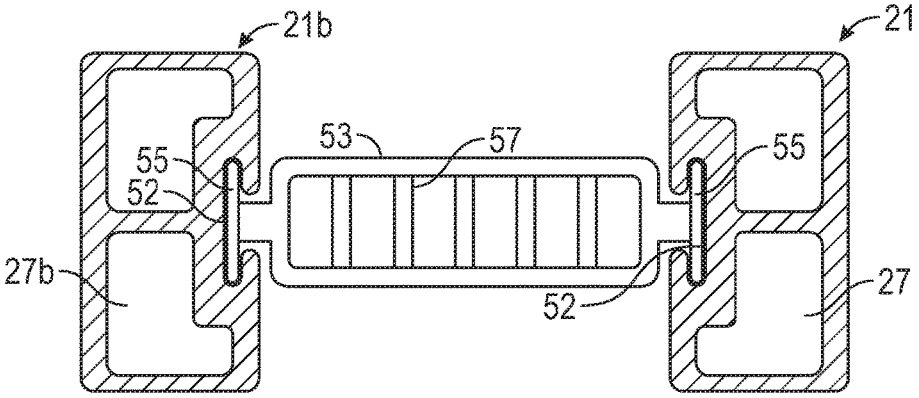
FIG. 5 is a partially-sectioned end view of still another embodiment of forms mounted to a spacer.

Embodiments of the system may further include a second lineal 21*b* (FIGS. 1 and 2). The second lineal 21*b* may be configured to be located opposite the lineal 21 with respect to the footer 23. Versions of the second lineal 21*b* may have a second recess 52 (FIG. 5).

Some examples of the system may include a spacer 53 for the lineals 21. The system may include lineals 21 configured to be horizontal concrete forms on opposite sides of the footer 23. Each lineal 21 may include a rectilinear tubular structure having a cavity 27. Drain perforations 31 may be formed in the lineals 21 to permit fluid transmission from the cavity 27 to an exterior thereof. The spacer 53 may be configured to be mounted to and extend between the lineals 21. The spacer 53 may be configured to be buried in poured concrete of the footer 23 and left in place.

The spacer 53 may be provided with spacer ribs 55. Embodiments of the spacer 53 may be configured to be mounted to and extend between the lineal 21 and second lineal 21*b*. In one version, the spacer ribs 55 may be configured to engage and be retained in a recess 52 and the second recess 52. In addition, the spacer 53 may be configured to be buried in poured concrete of the footer 23 (FIG. 2) and left in place. In one example, the spacer 53 may be elongated and hollow, and may include a plurality of internal reinforcement ribs 57. In some versions, each spacer rib 55 may comprise a T-shaped bracket, and each recess 52 may comprise a complementary T-shaped slot.

Figure 10A:
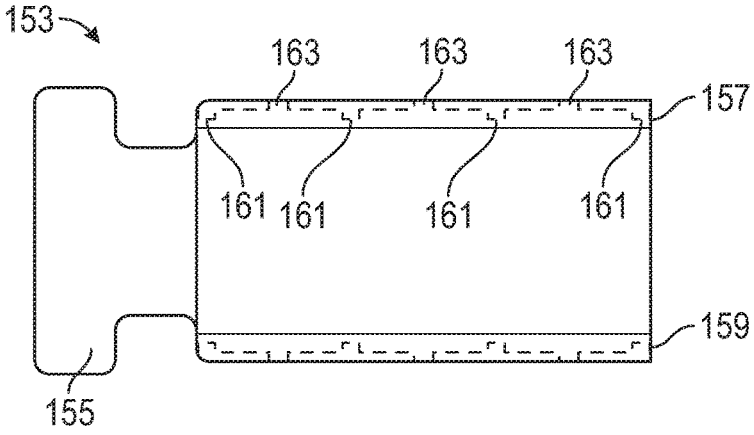
FIGS. 10A and 10B are front and side views, respectively, of an embodiment of spacer.
Figure 10B:
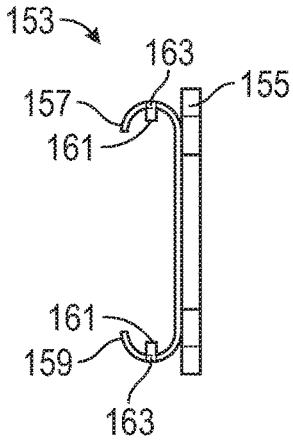
Figure 10C:
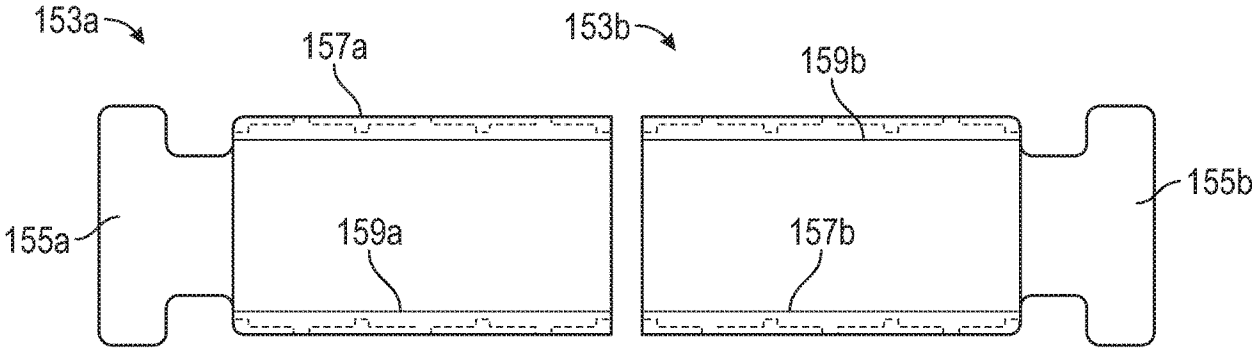
FIG. 10C is a front view of the two of the spacers of FIG. 10A, shown pre-assembly.
Figure 10D:
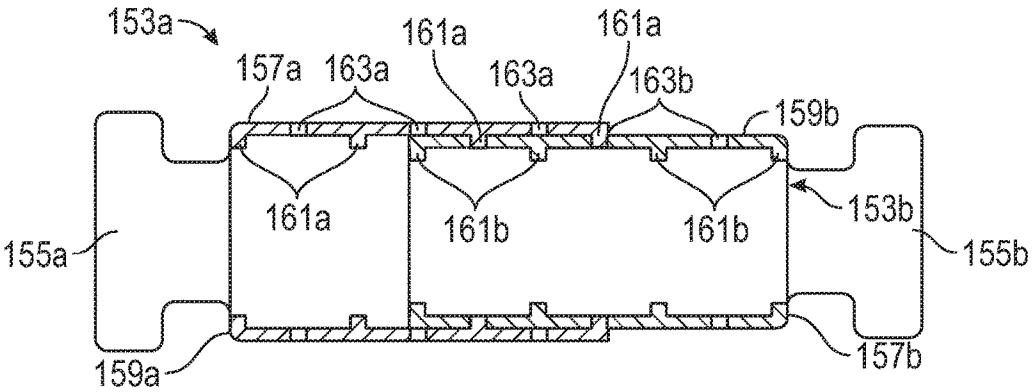
FIGS. 10D and 10E are front and side post-assembly views, respectively, of the spacers of FIG. 10C.
Figure 10E:
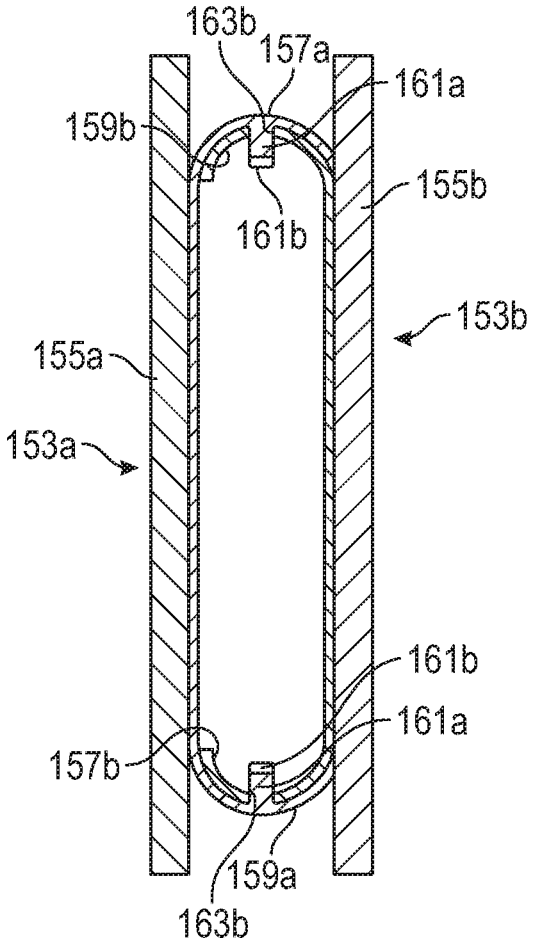

Embodiments of the system may include a version of the spacer that comprises a pair of complementary components. In some examples, the pair of complementary components may comprise molded or extruded polymers. In the embodiments of FIGS. 10A-10E, spacers 153 may be configured to be selectively adjustable relative to each other to releasably set a distance between the lineal 21 and the second lineal 21*b* (FIG. 5). Embodiments of spacer 153 may include a rib 155 for engaging lineal 21 in a manner similar to that shown in FIG. 5. The spacer 153 may comprise a molded component with cooperative (e.g., complementary) geometry along its top and bottom edges 157, 159. When two of the spacers 153 are inverted and oriented in opposite directions relative to each other (FIG. 10C), they can slidably engage each other to form an assembly (FIGS. 10D and 10E).

In addition, top edge 157 of spacer 153 may be provided with detents 161 in an interior thereof. Detents 161 may selectively engage recesses 163 in bottom edge 159 to maintain the assembly at its desired size. The detents 161 and recesses 163 may be provided at selected distances to assist a user in setting uniform spaces between the lineals 21.

Still other embodiments of the system may further include an accessory 61 (FIG. 2). In an example, accessory 61 may be configured to be a water barrier between the footer 23 and the wall 25. Versions of the accessory 61 may be configured to be pushed into the footer 23 and embed partially therein when the footer 23 is freshly poured concrete. The horizontal portion of accessory 61 acts as a stop to prevent its over-insertion into the wet footer 23. The accessory 61 may be further configured to protrude from the footer 23 when the footer 23 is at least partially cured. In addition, an exposed portion 63 of the accessory 61 may be configured to extend beyond an exterior of the footer 23. Versions of the exposed portion 63 may be configured to be embedded in the wall 25 when the wall 25 is poured as concrete on the footer 23. In a particular version, no portion of the accessory 61 may be visible after construction of the footer 23 and the wall 25, in contrast to the prior art. Depending on the application, the accessory 61 may comprise a molded or extruded polymer plate.

In addition, the spacer (e.g., spacer 53 or 153) may further include a vertical rib extending therefrom (not shown, but similar to other vertical rib embodiments disclosed herein). For example, the vertical rib may be configured to extend from the spacer above a top of the footer 23 and into the wall 25 when the wall 25 is poured as concrete. The vertical rib may form a water barrier between the footer 23 and the wall 25.

Figure 6:
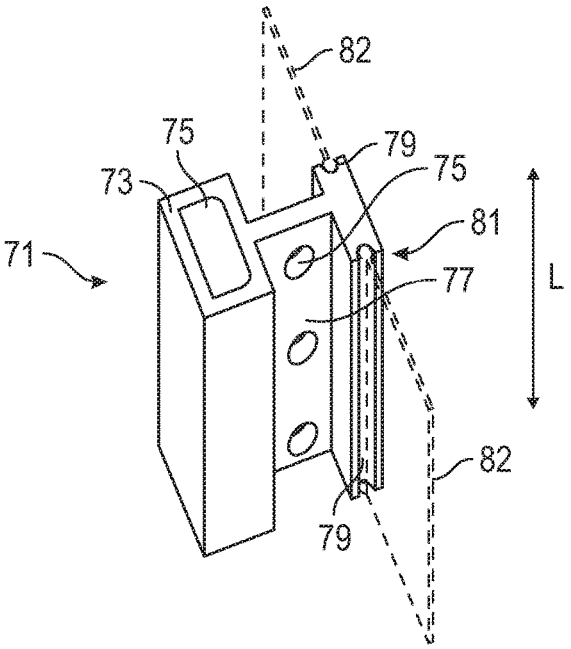
FIG. 6 depicts assembly and isometric views of an embodiment of a concrete wall form.

Embodiments of the system may further include a column 71 (FIG. 6) configured to be a vertical concrete wall form for the wall 25 (FIGS. 1 and 2). In a version, the column 71 may be formed from a molded or extruded polymer. Examples of the column 71 may include an I-beam section profile along a length L thereof. A rectilinear structure 73 may be provided. The rectilinear structure 73 may be configured to act as a stud for the wall 25. A cavity 75 may be located on a first end of the column 71. The cavity 75 may extend the length L of the column 71. In addition, the column 71 may include a web 77. The web 77 may contain apertures 75 that spaced apart from each other and extend along a web 77 for the length L of the column 71 for poured concrete flow therethrough. Further, recesses 79 may be formed on a second end 81 of the column 71. In an example, the recesses 79 may extend the length L of the column 71. The recesses 79 may be configured to be coupled to waterproof membranes 82.

Figure 7:
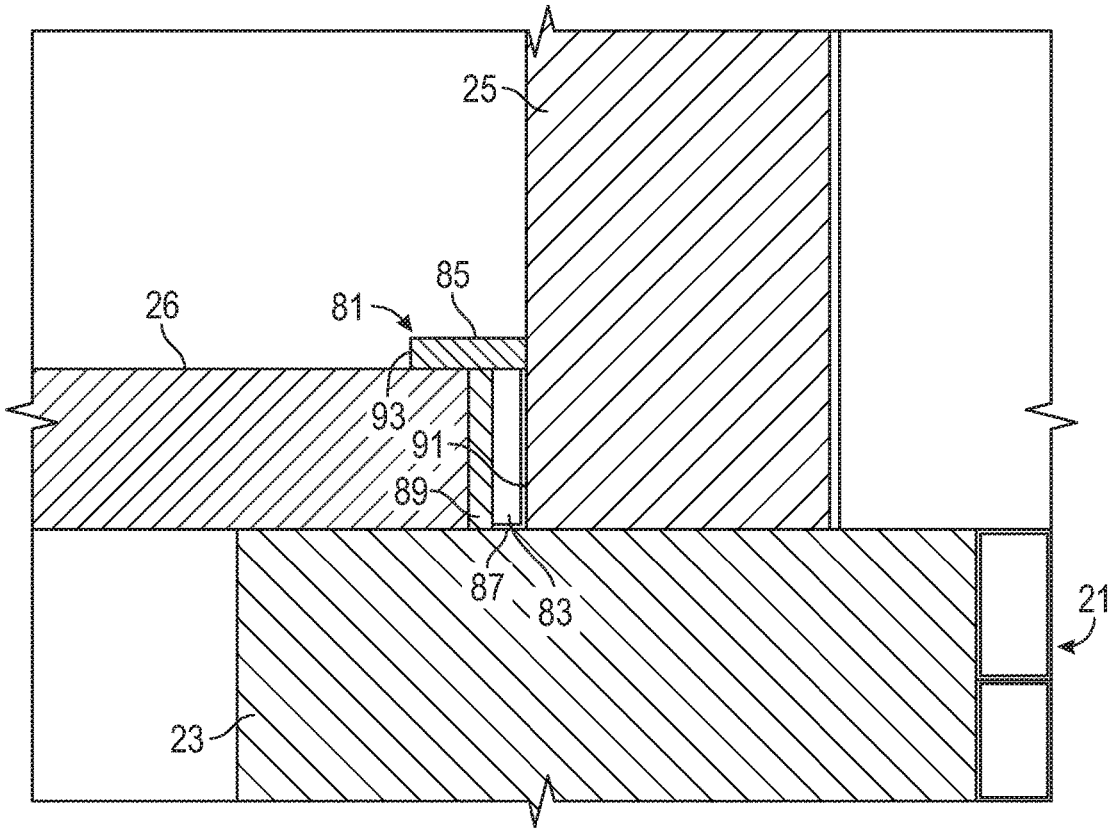
FIG. 7 is a sectional end view of an embodiment of a basement floor drain component.

Referring again to FIGS. 2 and 7, the basement floor 26 may be located on top of the footer 23 and extend to the wall 25. Embodiments of the system may further include a remedial drainage conduit. Examples of the remedial drainage conduit may comprise an elongated box 81 configured to be located on top of the footer 23. In addition, the elongated box 81 may be configured to be positioned in a void 83 formed by removing a portion of the basement floor 26 adjacent to the wall 25. Versions of the elongated box 81 may be hollow with a top wall 85, a bottom wall 87, and inner and outer walls 89, 91 extending between the top wall 85 and the bottom wall 87. In one example, an outer edge of the top wall 85 is flush with the outer wall 91 and configured to abut the wall 25. The top wall 85 can be wider than a distance between the inner and outer walls 89, 91, such that an inner edge 93 of the top wall 85 extends beyond the inner wall 89 to define a flange. In some versions, the flange may overlie a portion of the basement floor 26 adjacent the wall 25. In addition, the top wall 85 may be perforated to allow fluid flow from the basement to the hollow of the elongated box 81. Other portions of the elongated box 81 may be perforated to allow escape of the fluid therefrom. Versions of the elongated box 81 may be formed from a molded or extruded polymer.

Figure 8:
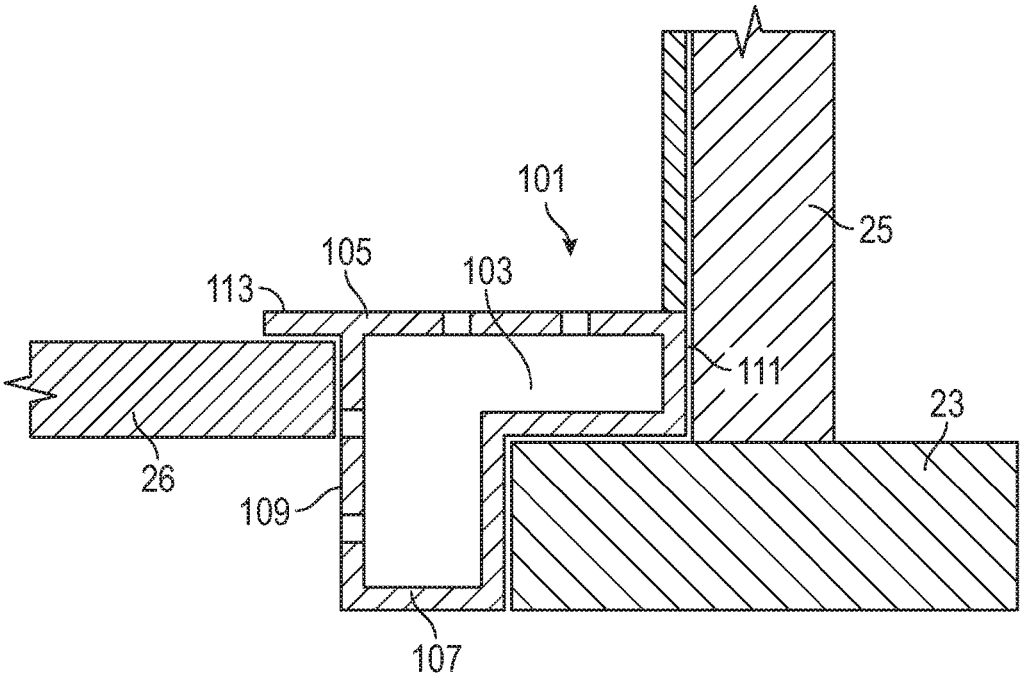
FIG. 8 is a sectional end view of another embodiment of a basement floor drain component.

As described herein, the basement floor 26 (FIG. 2) may be located on top of the footer 23 and extend to the wall 25. Embodiments of the system may further include a remedial drainage and ventilation conduit, such as a drain and vent box 101 (FIG. 8). The drain and vent box 101 may be configured to be located on top and on a side of the footer 23. The drain and vent box 101 may be configured to be positioned in a void 103 formed by removing a portion of the basement floor 26 adjacent to the wall 25. Versions of the drain and vent box 101 may be hollow with a top wall 105, a bottom wall 107, and inner and outer walls 109, 111 extending between the top wall 105 and the bottom wall 107. In some examples, an outer edge of the top wall 105 is flush with the outer wall 111 and configured to abut the wall 25. In a particular version, the top wall 105 can be wider than a distance between the inner and outer walls 109, 111, such that an inner edge 113 of the top wall 105 extends beyond the inner wall 109 to define a flange. Embodiments of the flange may overlie a portion of the basement floor 26 adjacent the wall 25. The top wall 105 may be perforated to allow fluid flow from the basement to the hollow of the drain and vent box 101. Other portions of the drain and vent box 101 may be perforated to allow the fluid to escape therefrom.

Embodiments of the drain and vent box 101 may be formed from a molded or extruded polymer. The drain and vent box 101 also may be formed as a plurality of ruggedized boxes that form an assembly. In one version, the drain and vent box 101 may be configured to not require concrete backfilling and provides sufficient strength for a user to stand on without substantial deflection.

Figure 11:
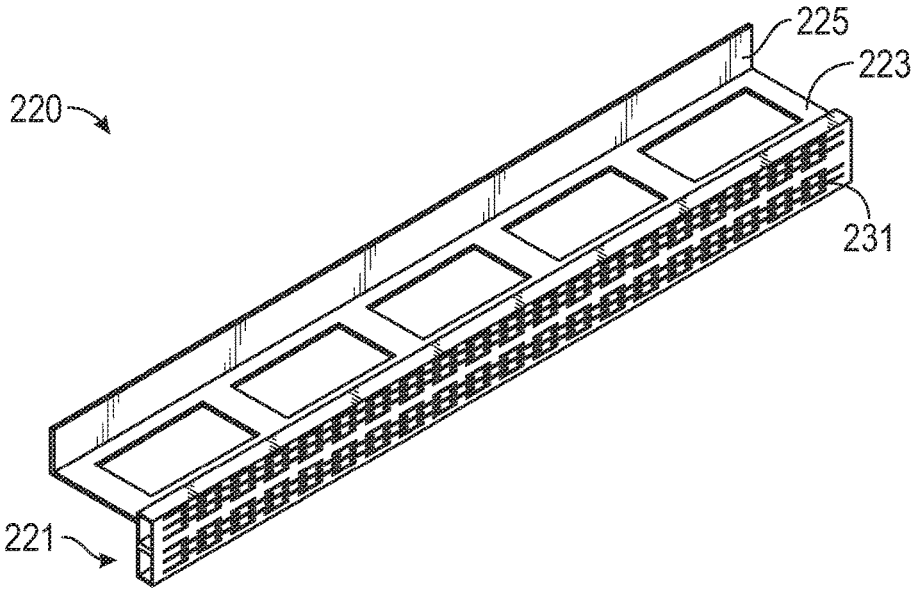
FIG. 11 is a top, front isometric view of an embodiment of a form.
Figure 12:
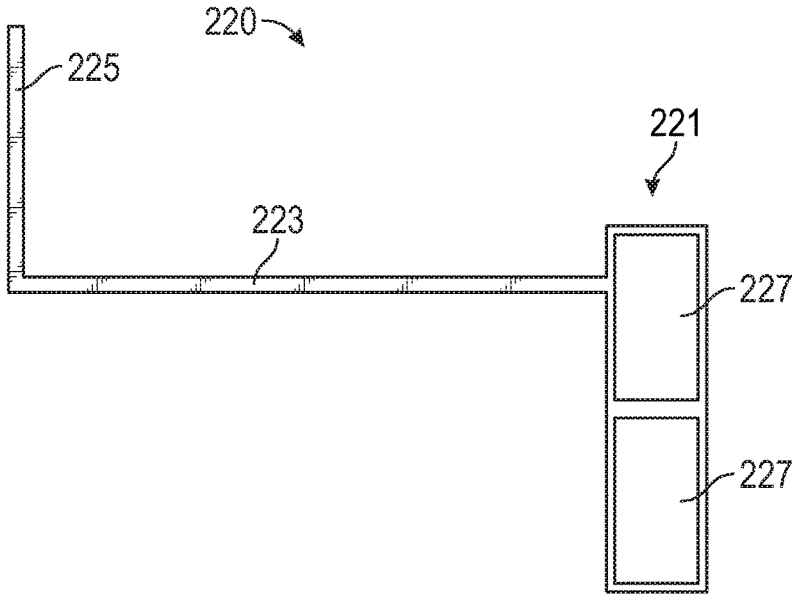
FIG. 12 is an end view of the form of FIG. 11.

Another embodiment of an apparatus 220 for a concrete form and drainage is illustrated in FIGS. 11 and 12. For example, the apparatus 220 may include a lineal 221 configured to be a horizontal concrete form for a footer 23 for a wall 25. See, e.g., FIGS. 1 and 2. The lineal 221 may include a rectilinear tubular structure having a cavity 227, and drain perforations 231 configured to permit fluid transmission from the cavity 227 to an exterior of the lineal 221. In some versions, a horizontal rib 223 may extend from the lineal 221. The horizontal rib 223 may be configured to extend into the footer 23 when the footer 23 is poured as concrete. The horizontal rib 223 may be provided as a plurality of ribs, between which are apertures for poured concrete to flow through. The apparatus 220 also may include a vertical rib 225, which may extend from the horizontal rib 223. The vertical rib 225 may be configured to extend above a top of the footer 23 and into the wall 25 when the wall 25 is poured as concrete. The vertical rib 225 may form a water barrier between the footer 23 and the wall 25. In addition, the vertical rib 225 may be located at an approximate center of the footer 23 and at an approximate center of the wall 25.

Although not illustrated, the apparatus 220 may be provided with the horizontal rib 223 comprising a spacer that extends to an adjacent lineal 21 (FIG. 1) on an opposite side of the footer 23. The spacer may be configured to set a desired distance between the lineal 221 and the adjacent lineal 21.

Other versions include one or more of the following embodiments:

Embodiment 1

A system for a basement concrete form and drainage, the system comprising:

a lineal configured to be a horizontal concrete form for a footer for a wall and a basement floor, the lineal comprising a rectilinear tubular structure having a cavity, an outer wall, drain perforations in the outer wall configured to permit fluid transmission from the cavity to an exterior of the lineal; and a retainer configured to be mounted to a stake for the basement concrete form when the stake is embedded in a formation underlying the lineal, wherein the retainer is configured to be selectively vertically positioned along the stake to adjust a height of the lineal relative to the underlying formation.

Embodiment 2

The system of any of these embodiments, wherein the retainer is configured to be mounted to the stake by at least one of sliding and clamping, the retainer holds its position vertically, relative to the stake, and supports a weight of the lineal and the retainer as an assembly without unintentionally slipping down the stake.

Embodiment 3

The system of any of these embodiments, wherein the retainer comprises a lever that is spring-loaded to selectively grip the stake to releasably retain the assembly at a desired vertical elevation relative to the stake.

Embodiment 4

The system of any of these embodiments, wherein the lineal comprises a recess formed in the outer wall, and the retainer comprises a rib that is complementary to and configured to be coupled to the recess in the lineal.

Embodiment 5

The system of any of these embodiments, wherein the recess comprises a plurality of recesses and the rib comprises a plurality of ribs that are complementary to the plurality of recesses.

Embodiment 6

The system of any of these embodiments, wherein each recess comprises a cylindrical socket, and each rib comprises a cylindrical knob.

Embodiment 7

The system of any of these embodiments, wherein the retainer comprises a top arm that secures over a top of the lineal, a bottom arm that secures under a bottom of the lineal, such that the lineal is at least partially clamped inside the retainer.

Embodiment 8

The system of any of these embodiments, wherein the lineal further comprises a plurality of sets of clips on the exterior, wherein each set of clips is configured to attach to an accessory.

Embodiment 9

The system of any of these embodiments, wherein both the lineal and the retainer comprise molded or extruded polymers.

Embodiment 10

The system of any of these embodiments, further comprising a second lineal configured to be located opposite the lineal with respect to the footer, the second lineal has a second recess, and a spacer having spacer ribs, wherein the spacer is configured to be mounted to and extend between the lineal and second lineal, the spacer ribs are configured to engage and be retained in a recess and the second recess, and the spacer is configured to be buried in poured concrete of the footer and left in place.

Embodiment 11

The system of any of these embodiments, wherein the spacer is elongated, hollow and comprises a plurality of internal reinforcement ribs, each spacer rib comprises a T-shaped bracket, and each recess comprises a T-shaped slot.

Embodiment 12

The system of any of these embodiments, wherein the spacer comprises a pair of complementary components that are selectively adjustable relative to each other to releasably set a distance between the lineal and the second lineal.

Embodiment 13

The system of any of these embodiments, wherein the pair of complementary components comprise molded or extruded polymers.

Embodiment 14

The system of any of these embodiments, further comprising an accessory configured to be a water barrier between the footer and the wall, the accessory is configured to be pushed into the footer and embed partially therein when the footer is freshly poured concrete, the accessory is configured to protrude from the footer when the footer is at least partially cured, an exposed portion of the accessory is configured to extend beyond an exterior of the footer, and the exposed portion is configured to be embedded in the wall when the wall is poured as concrete on the footer, such that no portion of the accessory is visible after construction of the footer and the wall.

Embodiment 15

The system of any of these embodiments, wherein the accessory comprises a molded or extruded polymer plate.

Embodiment 16

The system of any of these embodiments, further comprising a column configured to be a vertical concrete wall form for the wall, the column has an I-beam section profile along a length L thereof, a rectilinear structure having a cavity on a first end of the column and extending the length L of the column, the rectilinear structure is configured to act as a stud for the wall, apertures spaced apart from each other and extending along a web for the length of the column for poured concrete flow therethrough, recesses on a second end of the column, the recesses extend the length of the column, and the recesses are configured to be coupled to waterproof membranes.

Embodiment 17

The system of any of these embodiments, wherein the column comprises a molded or extruded polymer.

Embodiment 18

The system of any of these embodiments, wherein the basement floor is located on top of the footer and extends to the wall, and the system further comprises an elongated box configured to act as a remedial drainage conduit on top of the footer, wherein the elongated box is configured to be positioned in a void formed by removing a portion of the basement floor adjacent to the wall, the elongated box is hollow with a top wall, a bottom wall, and inner and outer walls extending between the top wall and the bottom wall, an outer edge of the top wall is flush with the outer wall and configured to abut the wall, the top wall is wider than a distance between the inner and outer walls, such that an inner edge of the top wall extends beyond the inner wall to define a flange, the flange overlies a portion of the basement floor adjacent the wall, and the top wall is perforated to allow fluid flow to the hollow of the elongated box.

Embodiment 19

The system of any of these embodiments, wherein the elongated box comprises a molded or extruded polymer.

Embodiment 20

The system of any of these embodiments, wherein the basement floor is located on top of the footer and extends to the wall, and the system further comprises a drain and vent box configured to act as a remedial drainage and ventilation conduit on top and on a side of the footer, wherein the drain and vent box is configured to be positioned in a void formed by removing a portion of the basement floor adjacent to the wall, the drain and vent box is hollow with a top wall, a bottom wall, and inner and outer walls extending between the top wall and the bottom wall, an outer edge of the top wall is flush with the outer wall and configured to abut the wall, the top wall is wider than a distance between the inner and outer walls, such that an inner edge of the top wall extends beyond the inner wall to define a flange, the flange overlies a portion of the basement floor adjacent the wall, and the top wall is perforated to allow fluid flow to the hollow of the drain and vent box.

Embodiment 21

The system of any of these embodiments, wherein the drain and vent box comprises a molded or extruded polymer.

Embodiment 22

The system of any of these embodiments, wherein the drain and vent box comprises a plurality of ruggedized boxes that form an assembly.

Embodiment 23

The system of any of these embodiments, wherein the drain and vent box is configured to not require concrete backfilling and provides sufficient strength for a user to stand on without substantial deflection.

Embodiment 24

An apparatus for adjusting a height of a concrete form relative to a formation underlying the concrete form, the apparatus comprising:

a retainer configured to be mounted to the concrete form and define an assembly, the assembly is configured to be mounted to a stake extending from the underlying formation by at least one of sliding and clamping, the assembly is configured to be selectively vertically positioned along the stake to adjust the height of the assembly relative to the underlying formation, such that the assembly holds the vertical position on the stake while supporting a weight of the assembly without unintentionally moving down the stake.

Embodiment 25

The apparatus of any of these embodiments, wherein the retainer comprises a lever having a spring that loads the lever against the stake to selectively grip the stake to releasably retain the assembly at the vertical position relative to the underlying formation.

Embodiment 26

The apparatus of any of these embodiments, wherein the spring comprises at least one of a compression spring, a clock spring and a flex finger that is integral with the lever.

Embodiment 27

The apparatus of any of these embodiments, wherein the lever pivots about a pin, and the lever comprises a pawl for gripping the stake.

Embodiment 28

A system for a basement concrete form and drainage, the basement having a footer for a wall and a basement floor, the system comprising:

lineals configured to be horizontal concrete forms on opposite sides of the footer, each lineal comprising a rectilinear tubular structure having a cavity, and drain perforations configured to permit fluid transmission from the cavity to an exterior thereof; and a spacer configured to be mounted to and extend between the lineals, and the spacer is configured to be buried in poured concrete of the footer and left in place.

Embodiment 29

The system of any of these embodiments, wherein the spacer is elongated, hollow and comprises a plurality of internal reinforcement ribs.

Embodiment 30

The system of any of these embodiments, wherein each lineal comprises a recess on an exterior thereof, and the spacer comprises spacer ribs configured to be mounted to and engage the recesses in the lineals.

Embodiment 31

The system of any of these embodiments, wherein each recess comprises a T-shaped slot, and each spacer rib comprises a T-shaped bracket configured to engage a respective one of the T-shaped slots.

Embodiment 32

The system of any of these embodiments, wherein the spacer comprises a plurality of components that are complementary to each other and selectively adjustable relative to each other to define a distance between the lineals.

Embodiment 33

The system of any of these embodiments, wherein the components comprise molded or extruded polymers.

Embodiment 34

The system of any of these embodiments, wherein each component is substantially flat with a top edge lip and a bottom edge lip, the top and bottom edge lips are complementary to each other, such that when two of the components are inversely oriented the top edge lip of one component is configured to slidably engage the bottom edge lip of the other component to form an assembly.

Embodiment 35

The system of any of these embodiments, wherein one of the top and bottom edges comprises detents, and the other of the top and bottom edges comprises recesses that selectively engage the detents to maintain the assembly at a desired width.

Embodiment 36

The system of any of these embodiments, wherein the spacer comprises a vertical rib extending therefrom, the vertical rib is configured to extend above a top of the footer and into the wall when the wall is poured as concrete, such that the vertical rib forms a water barrier between the footer and the wall.

Embodiment 37

An apparatus for providing a water barrier between a footer and a wall extending from the footer, a concrete form relative to a formation underlying the concrete form, the apparatus comprising:

an accessory configured to be pushed into the footer and embed partially therein when the footer is freshly poured concrete, the accessory is configured to protrude from a top of the footer when the footer is at least partially cured, an exposed portion of the accessory is configured to extend beyond the top of the footer, and the exposed portion is configured to be embedded in the wall when the wall is poured as concrete on the footer, such that no portion of the accessory is visible after construction of the footer and the wall.

Embodiment 38

An apparatus for a concrete form and drainage, the apparatus comprising:

a lineal configured to be a horizontal concrete form for a footer for a wall, the lineal comprising a rectilinear tubular structure having a cavity, drain perforations configured to permit fluid transmission from the cavity to an exterior of the lineal;

a horizontal rib extending from the lineal, the horizontal rib being configured to extend into the footer when the footer is poured as concrete; and a vertical rib extending from the horizontal rib, the vertical rib being configured to extend above a top of the footer and into the wall when the wall is poured as concrete, such that the vertical rib forms a water barrier between the footer and the wall.

Embodiment 39

A form for a vertical wall formed from poured concrete, the form comprising:

a column having an I-beam sectional profile along a length thereof, a rectilinear structure having a cavity on a first end of the column and extending the length of the column, the rectilinear structure is configured to act as a stud for the vertical wall, the column also having a web extending from the rectilinear structure, the web having apertures spaced apart from each other and extending along the length of the column for poured concrete flow therethrough, and the column having a second end opposite the first end, the second end having external recesses extending the length of the column, and the recesses are configured to be coupled to waterproof membranes.

Embodiment 40

A conduit configured to provide remedial drainage for a basement having a footer, a wall extending from the footer and a basement floor located on top of the footer adjacent the wall, the conduit comprising:

a lineal configured to be positioned in a void formed by removing a portion of the basement floor adjacent to the wall, the lineal is located on top of the footer, the lineal is hollow with a top wall, a bottom wall, and inner and outer walls extending between the top wall and the bottom wall, an outer edge of the top wall is substantially flush with the outer wall and configured to abut the wall, the top wall is wider than a distance between the inner and outer walls, such that an inner edge of the top wall extends beyond the inner wall to define a flange, the flange overlies a portion of the basement floor adjacent the void, and the lineal is perforated to allow fluid flow therethrough.

Embodiment 41

A conduit for remedial draining and venting of a basement having a footer, a wall extending from the footer and a basement floor located on top of the footer adjacent the wall, the conduit comprising:

a lineal configured to be positioned in a void formed by removing a portion of the basement floor adjacent to the wall, such that the lineal is located on a top and on a side of the footer, the conduit is hollow with a top wall, a bottom wall, and inner and outer walls extending between the top wall and the bottom wall, an outer edge of the top wall is flush with the outer wall and configured to abut the wall, the top wall is wider than a distance between the inner and outer walls, such that an inner edge of the top wall extends beyond the inner wall to define a flange, the flange overlies a portion of the basement floor adjacent the void, and the lineal is perforated to allow fluid flow to the hollow of the conduit.

Embodiment 42

The conduit of any of these embodiments, wherein the conduit comprises a molded or extruded polymer.

Embodiment 43

The conduit of any of these embodiments, wherein the conduit is configured to not require concrete backfilling and provides sufficient strength for a user to stand on without substantial deflection.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A system for a basement concrete form and drainage, the system comprising:

a lineal configured to be a horizontal concrete form for a footer for a basement wall and a basement floor, the basement floor is located on a top of the footer, the lineal comprising a rectilinear tubular structure having a cavity, an outer wall, and drain perforations configured to permit fluid transmission from the cavity to an exterior of the lineal; and a drain and vent box positioned in a void between the basement floor and the basement wall, the drain and vent box having a portion located on the top of the footer and a portion located on a side of the footer and being configured to act as a remedial drainage and ventilation conduit, the drain and vent box being hollow and having a top wall, a bottom wall, and inner and outer walls extending between the top wall and the bottom wall, wherein the top wall is wider than a distance between the inner and outer walls, such that an inner edge of the top wall extends beyond the inner wall to define a flange, and wherein the flange overlies a portion of the basement floor adjacent the basement wall.

2. The system of claim 1, wherein an outer edge of the top wall is flush with the outer wall and configured to abut the basement wall.

3. The system of claim 1, wherein the top wall is perforated to allow fluid flow to the hollow of the drain and vent box, and at least another portion of the drain and vent box is perforated to allow the fluid to escape therefrom.

4. The system of claim 1, wherein the drain and vent box comprises a plurality of ruggedized boxes that form an assembly, and the assembly is configured to not require concrete backfilling and provide sufficient strength for a user to stand on without substantial deflection.

5. A system for a basement concrete form and drainage, the system comprising:

a lineal configured to be a horizontal concrete form for a footer for a basement wall and a basement floor, the basement floor is located on a top of the footer, the lineal comprising a rectilinear tubular structure having a cavity, an outer wall, and drain perforations configured to permit fluid transmission from the cavity to an exterior of the lineal; and an elongated box positioned in a void between the basement wall and the basement floor and having a portion positioned on the top of the footer, the elongated box being configured to act as a remedial drainage conduit, wherein the void is formed by a first portion of the basement floor having been removed adjacent to the basement wall, wherein the elongated box includes a drain and vent box configured to also act as a ventilation conduit, wherein the drain and vent box is hollow and includes a top wall, a bottom wall, and inner and outer walls extending between the top wall and the bottom wall, wherein the top wall is wider than a distance between the inner and outer walls, such that an inner edge of the top wall extends beyond the inner wall to define a flange, and wherein the flange overlies a second portion of the basement floor adjacent the basement wall.

6. The system of claim 5, wherein both the lineal and the elongated box comprise molded or extruded polymers.

7. The system of claim 5, wherein another portion of the drain and vent box also is configured to be located on a side of the footer.

8. The system of claim 5, wherein an outer edge of the top wall is flush with the outer wall and configured to abut the basement wall.

9. The system of claim 5, wherein the drain and vent box comprises a plurality of ruggedized boxes that form an assembly.

10. The system of claim 5, wherein the drain and vent box is configured to not require concrete backfilling and provide sufficient strength for a user to stand on without substantial deflection.

11. The system of claim 5, wherein the top wall is perforated to allow fluid flow to the hollow of the drain and vent box.

12. The system of claim 11, wherein at least another portion of the drain and vent box is perforated to allow the fluid to escape from the hollow.

* * * * *